US010421179B2

(12) United States Patent
Liu

(10) Patent No.: US 10,421,179 B2
(45) Date of Patent: Sep. 24, 2019

(54) DAMPING RETURN HAMMER

(71) Applicant: Qianyi Liu, Guangzhou (CN)

(72) Inventor: Qianyi Liu, Guangzhou (CN)

( * ) Notice: Subject to any disclaimer, the term of this patent is extended or adjusted under 35 U.S.C. 154(b) by 22 days.

(21) Appl. No.: 15/548,044

(22) PCT Filed: Feb. 1, 2016

(86) PCT No.: PCT/CN2016/000068
§ 371 (c)(1),
(2) Date: Aug. 1, 2017

(87) PCT Pub. No.: WO2016/127728
PCT Pub. Date: Aug. 18, 2016

(65) Prior Publication Data

US 2018/0264635 A1 Sep. 20, 2018

(30) Foreign Application Priority Data

Feb. 10, 2015 (CN) ..... 2015 2 0094010 U

(51) Int. Cl.
*B25D 1/12* (2006.01)
*B25G 1/01* (2006.01)
(Continued)

(52) U.S. Cl.
CPC ..... *B25D 1/12* (2013.01); *B25G 1/01* (2013.01); *B25G 3/26* (2013.01); *B25G 3/38* (2013.01); *B25D 2222/57* (2013.01)

(58) Field of Classification Search
CPC ..... B25D 1/12; B25D 2222/57; B25D 1/00; B25D 1/02; A61H 23/06; B25G 1/01; B25G 3/26; B25G 3/38; B25G 1/10
See application file for complete search history.

(56) References Cited

U.S. PATENT DOCUMENTS 967,703 A 8/1910 Bagnall
2,518,059 A * 8/1950 Pemmerl ..... B25D 1/02 81/19
(Continued)

FOREIGN PATENT DOCUMENTS

CN 201431613 3/2010
CN 201453610 5/2010
(Continued)

OTHER PUBLICATIONS

International Search Report dated Mar. 24, 2016 from corresponding application No. PCT/CN2016/000068.
(Continued)

*Primary Examiner* — Robert J Scruggs
(74) *Attorney, Agent, or Firm* — Hauptman Ham, LLP

(57) ABSTRACT

A damping return hammer includes a grip handle, a first elastic damping arm, a second elastic damping arm, and a hammer head provided at the fronts of the first elastic damping arm and the second elastic damping arm, respectively. The front ends of the first elastic damping arm and the second elastic damping arm are upper and lower respectively, and extend at a certain distance forward and are in the same longitudinal section. The two hammer heads are provided at the front ends of the first elastic damping arm and the second elastic damping arm respectively. A gap is between the two hammer heads and is fitted therein with a rubber energy-storage cushion block.

7 Claims, 8 Drawing Sheets

(51) Int. Cl.
*B25G 3/26* (2006.01)
*B25G 3/38* (2006.01)

(56) References Cited

U.S. PATENT DOCUMENTS

| | | | | | |
|---|---|---|---|---|---|
| 2,656,225 | A * | 10/1953 | Saylor | B25D 1/12 | 403/203 |
| 4,633,741 | A * | 1/1987 | Yang | B25G 1/01 | 81/19 |
| 2006/0144195 | A1* | 7/2006 | Tanga | B25D 1/00 | 81/20 |

FOREIGN PATENT DOCUMENTS

| | | |
|---|---|---|
| CN | 103251497 | 8/2013 |
| CN | 104669207 | 6/2015 |
| CN | 204505183 | 7/2015 |
| EP | 1 621 295 | 2/2006 |

OTHER PUBLICATIONS

Written Office Action by International Searching Authority dated Mar. 18, 2016 and English translation from corresponding application No. PCT/CN2016/000068.

* cited by examiner

DAMPING RETURN HAMMER

RELATED APPLICATIONS

The present application is a National Phase of International Application Number PCT/CN2016/000068, Feb. 1, 2016, and claims the priority of China Application No. 201520094010.6, filed Feb. 10, 2015.

TECHNICAL FIELD OF THE PRESENT INVENTION

The present invention relates to the field of a hardware tool, and specifically to a damping return hammer.

TECHNICAL BACKGROUND OF THE PRESENT INVENTION

A traditional hammer structure comprises a grip handle and a hammer head provided in the front of the grip handle, when this structure of the hammer is used, because the hammer and the grip handle are fixedly connected, when the hammer acts directly on a nail or an object needed to be hammered, according to the principle of the acting force and the reacting force of a force, except that the object to be hammered offsets a part of the force, a considerable part of the reacting force will rebound back, which will hence shake the user's arm, hence the user will feel uncomfortable, meanwhile the hammering effect is also discounted. It is an object of the present inventors to minimize the vibration generated by the hammer to the arm when the hammer is used.

SUMMARY OF THE PRESENT INVENTION

It is an object of the present invention to provide a damping return hammer which reduces vibration and improves work efficiency in view of the above-mentioned problems and deficiencies.

The technical solution of the present invention is realized as follows: a damping return hammer comprises a grip handle, a first elastic damping arm and a second elastic damping arm which are provided at the front ends of the grip handle, and hammer heads provided at the fronts of the first elastic damping arm and the second elastic damping arm, the front ends of the first elastic damping arm and the second elastic damping arm are upper and lower respectively, extend at a certain distance forward and are in the same longitudinal section, the two hammer heads are provided at the front ends of the first elastic damping arm and the second elastic damping arm respectively and the midperpendiculars of the hammer heads are coincident, a gap is provided between the two hammer heads and is fitted therein with a rubber energy-storage cushion block.

Furthermore, the connecting relation of the first elastic damping arm and the second elastic damping arm as well as the connecting manner of the first elastic damping arm and the second elastic damping arm as well as the grip handle have a plurality of structure manners, for example, the rear ends of the first elastic dampening arm and the second elastic damper arm are integrally connected to form a rear end integral connecting portion, the rear end integral connecting portion is connected with the grip handle via a socket wrench tooth mouth. Or for example, the first elastic damping arm and the second elastic damping arm are independent members and connected with the grip handle via a connecting piece respectively.

Furthermore, the two hammer heads are integrally connected with the first elastic damping arm and the second elastic damping arm, respectively and the connecting section thereof is thicker, to increase mass. Or the two hammer heads are connected with the first elastic damping arm and the second elastic damping arm via the connecting piece, respectively.

To reduce vibration, the two opposite faces nearest to the two hammer heads are provided thereon with the groove, the two ends of the rubber energy-storage cushion block are provided with the inserting block matched with the grooves, respectively, the rubber energy-storage cushion block, via the inserting block provided at the two ends thereof, is embedded in the grooves provided with the opposite faces between the two hammer heads to be integrally connected with the two hammer heads.

Furthermore, the socket wrench tooth mouth comprises a large sleeve and a small sleeve, the large sleeve and the small sleeve are provided with a large end and a small end, respectively, the outer diameter of the small end of the small sleeve is tightly matched with an inner hole of the small end of the large sleeve, the two outer sides of the small end of the large sleeve are provided with a stop step, respectively, the inner sides of the steps of the large ends of the large sleeve and the small sleeve are provided with limit tooth mouths, respectively; the middle sections of the first elastic dampening arm and the second elastic dampening arm are close to each other and the ends thereof are slightly separated, the rear end integral connecting portions of the first elastic dampening arm and the second elastic damper arm are in a thin arm arc connection, and have the function of a spring piece when in use, the rear end integral connecting portions of the first elastic dampening arm and the second elastic damper arm and the middle close to the middle section are hollowed out to form a forked connecting portion, the inner sides of the rear end of the forked connecting portion are provided with block slots, respectively; the connecting end of the grip handle is provided with a connecting portion, the two sides of the connecting portion are parallel to each other, the connecting portion is provided thereon with a connecting hole, one ring of a stop tooth mouth is provided on the two sides of the connecting portion and at the periphery of the connecting hole, respectively, the two inner sides of the connecting hole are provided with a limit step matched with the stop step respectively provided at the two outer sides of the small end of the large sleeve, respectively, the rear portions of the two sides of the connecting portion are provided with a convex block matched with the block slots respectively provided at the inner side of the rear end of the forked connecting portion, respectively; when in connection, the connecting portion of the connecting end of the grip handle extends into a fork of the forked connecting portion of the first elastic damping arm and the second elastic damping arm, the convex block respectively provided at the rear portions of the two sides of the connecting portion is embedded into the block slots provided at the inner side of the rear end of the forked connecting portion, under the action of external forces, the small ends of the large sleeve and the small sleeve are sleeved into the connecting hole provided at the connecting portion of the grip handle from the two outer sides of the rear end of the forked connecting portion of the first elastic damping arm and the second elastic damping arm, respectively, at this time, the stop step respectively provided at the two outer sides of the small ends of the large sleeve is matched with the limit step respectively provided at the two inner sides of the connecting hole, the outer diameter of the small end of the small sleeve is tightly matched with the inner hole of the small end of the large sleeve, the limit tooth mouths provided at the inner sides of the steps of the large ends of the large sleeve and the small sleeve are engaged with one ring of the stop tooth mouth respectively provided at the periphery of the connecting hole of the grip handle, so that the first elastic damping arm and the second elastic damping arm are firmly connected with the grip handle together, and prevented from relative rotation when in use.

Because the invention adopts the structure of the double elastic damping arms and the double hammer heads, and has the gap between the double hammer heads in which the rubber energy-storage cushion block is fitted, when in use, the resulting force of the hammering force and the inertia force of the upper hammer as well as the elastic reset release force of the rubber energy-storage cushion block resulted from the squeezing and energy storage acts on the below hammer, causing the lower hammer to have a greater downward impact force, thereby improving work efficiency. At the same time, the first elastic damping arm and the second elastic damping arm are provided to elastically damp, further reducing the impact force on the grip handle when hammering is carried out.

The invention is further described with reference to the following accompanying drawings.

EMBODIMENTS OF THE PRESENT INVENTION

Figure 1:
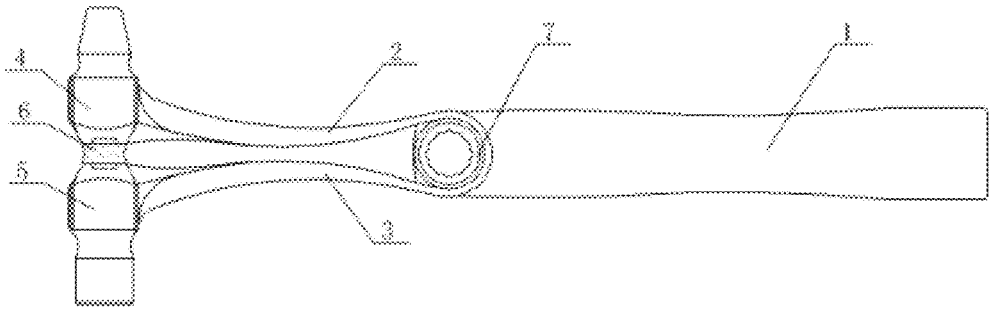
FIG. 1 is a structure diagram of the present invention.
Figure 2:
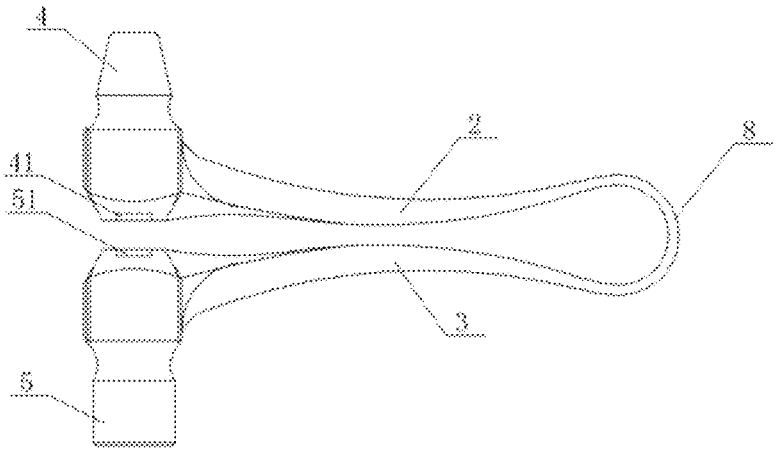
FIG. 2 is a schematic view of a structure in which rear ends of a first resilient damper arm and a second resilient damper arm are integrally connected according to one example of the present invention.
Figure 3:
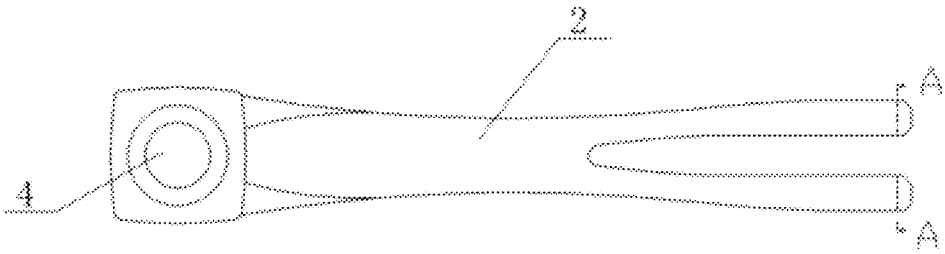
FIG. 3 is a top structural diagram of FIG. 2.
Figure 4:
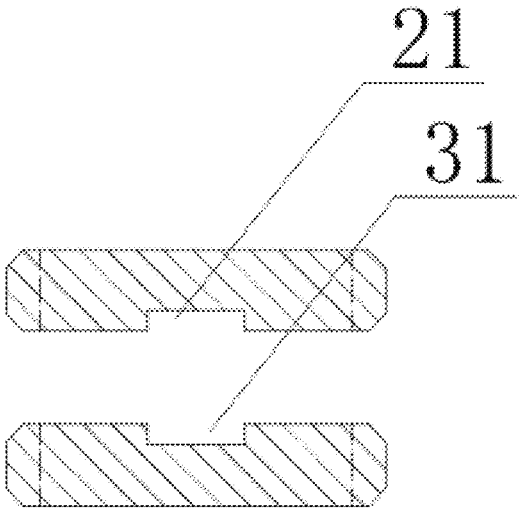
FIG. 4 is a cross-sectional structural diagram taken along line A-A of FIG. 3.
Figure 5:
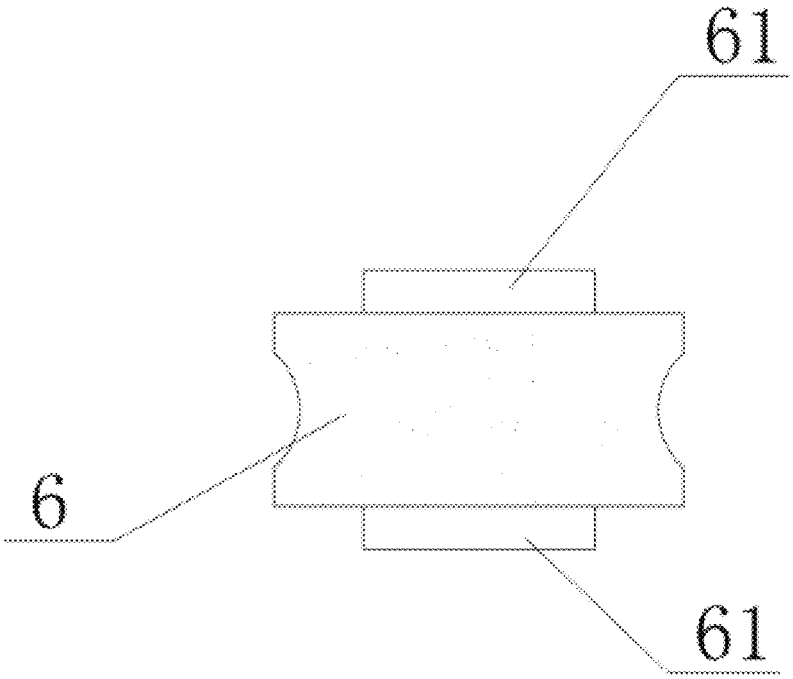
FIG. 5 is a structural diagram of a rubber energy-storage cushion block according to the present invention.
Figure 6:
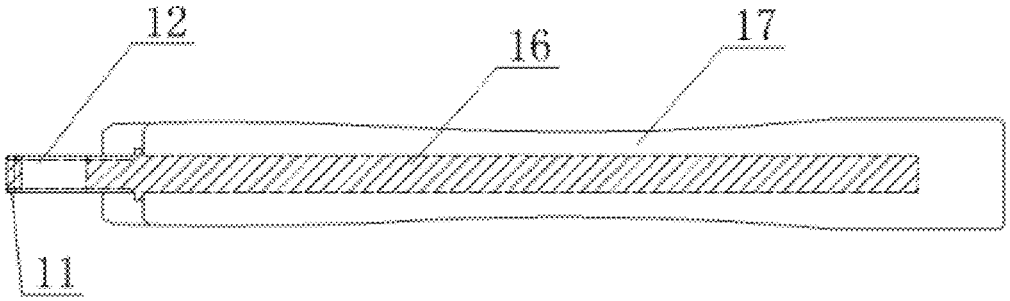
FIG. 6 is a cross-sectional structural diagram of a grip handle of the present invention.
Figure 7:
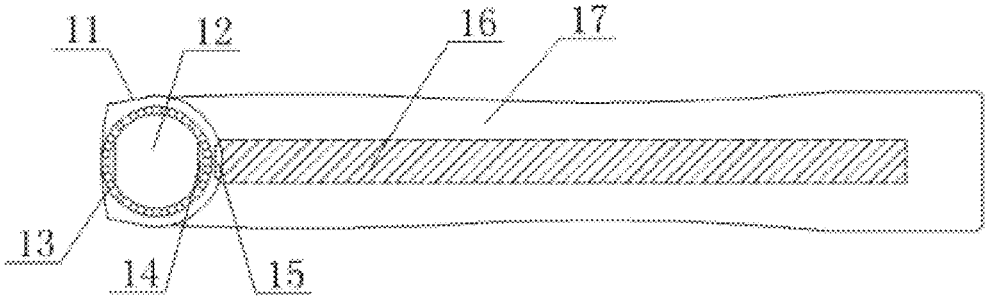
FIG. 7 is a structural diagram of one view of FIG. 6.
Figure 8:
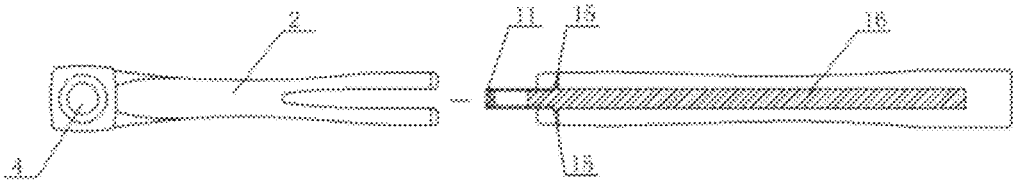
FIG. 8 is a diagram of an assembled structure according to an example of the present invention.
Figure 9:
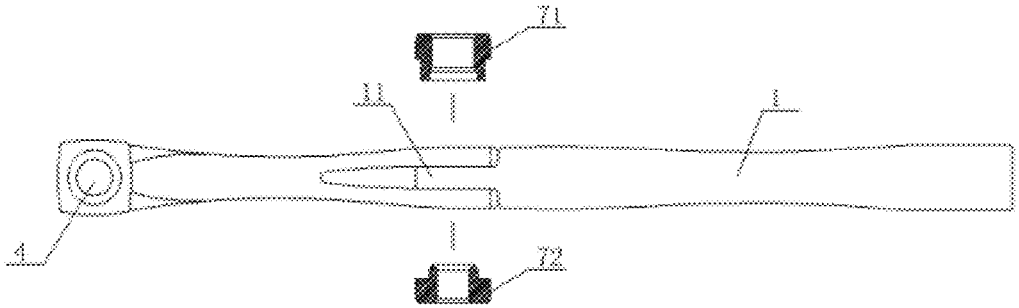
FIG. 9 is a diagram of an assembled structure according to an example of the present invention.
Figure 10:
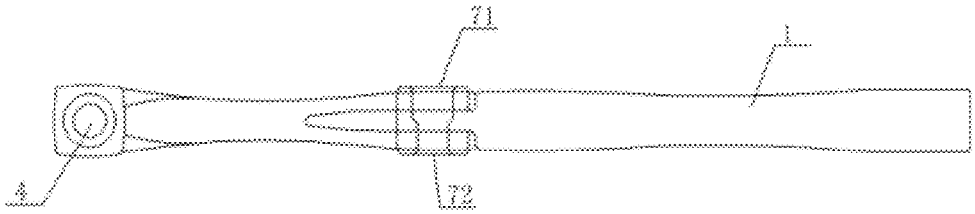
FIG. 10 is a diagram of an assembled structure according to an example of the present invention.
Figure 11:
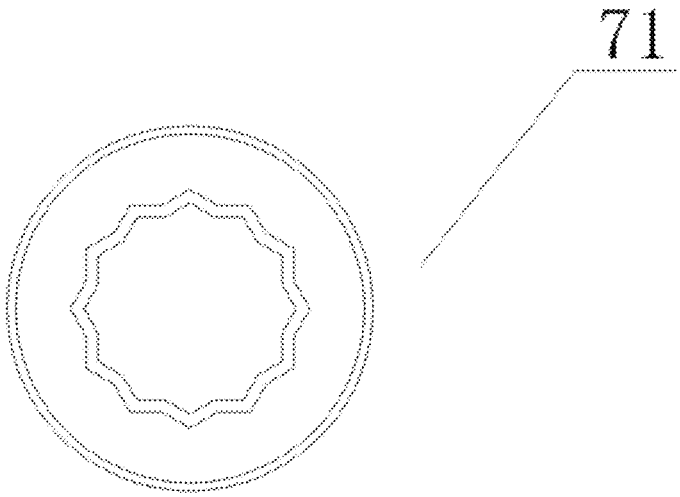
FIG. 11 is a structural diagram of a plan view of a large sleeve of the present invention.
Figure 12:
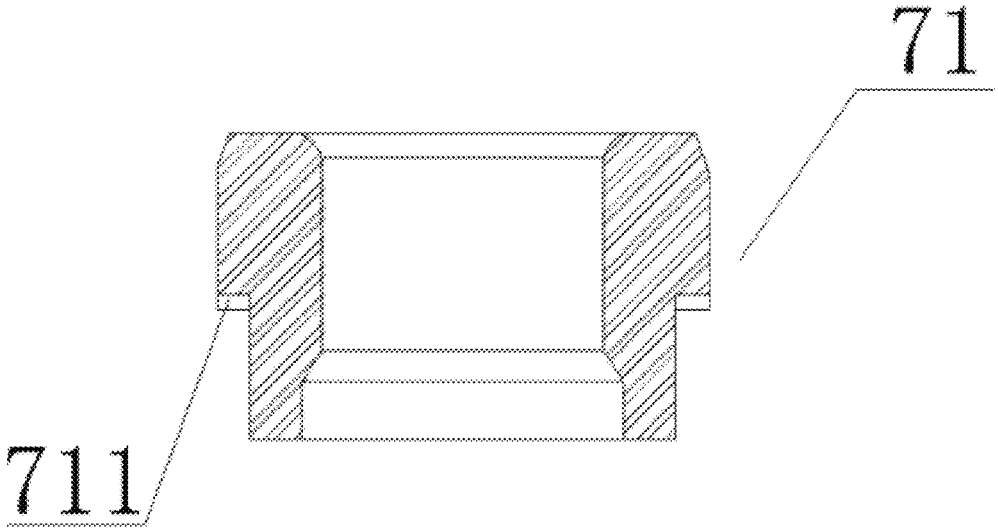
FIG. 12 is a structural diagram of a main view of a large sleeve of the present invention.
Figure 13:
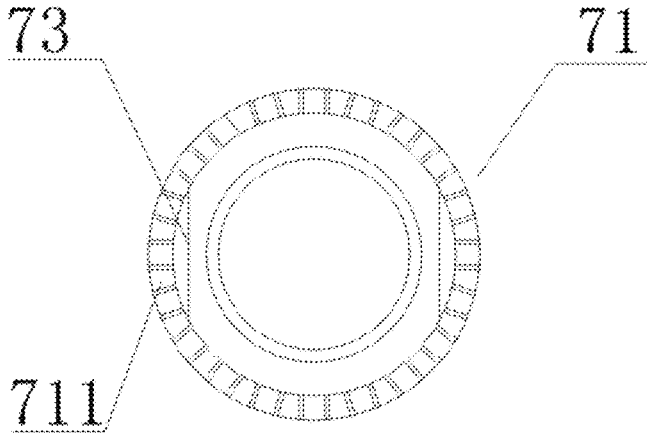
FIG. 13 is a structural diagram of an upward view of a large sleeve of the present invention.
Figure 14:
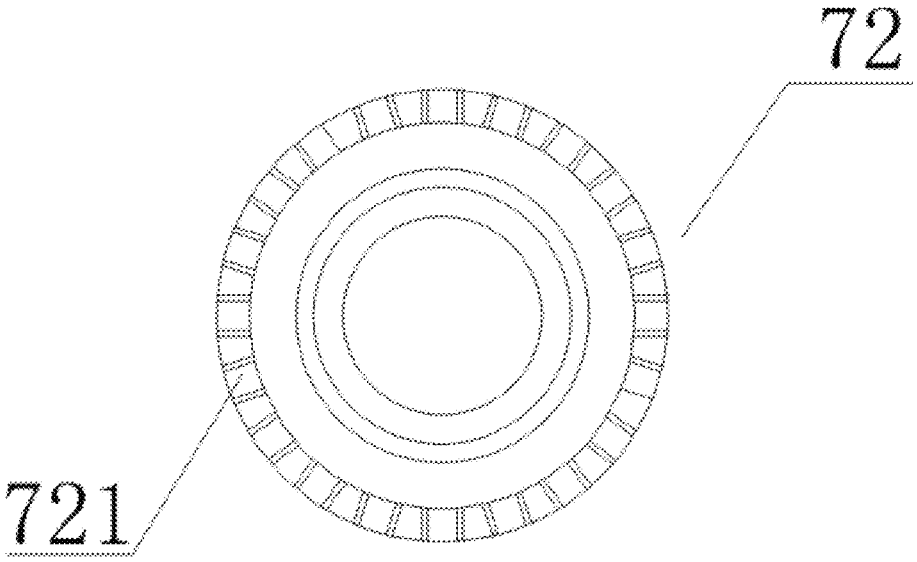
FIG. 14 is a structural diagram of a top view of a small sleeve of the present invention.
Figure 15:
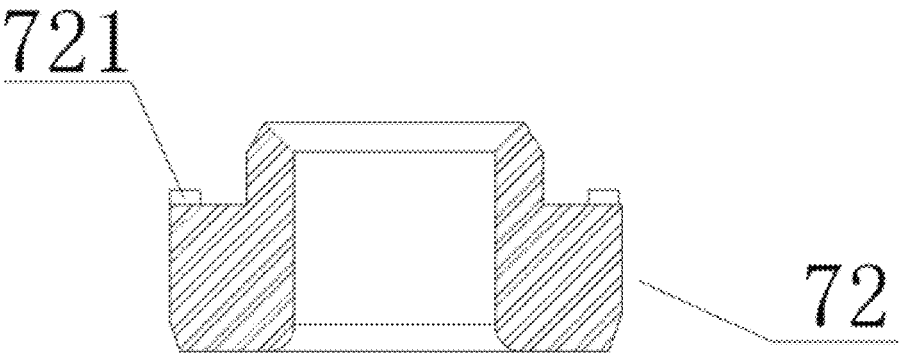
FIG. 15 is a structural diagram of a main view of a small sleeve of the present invention.
Figure 16:
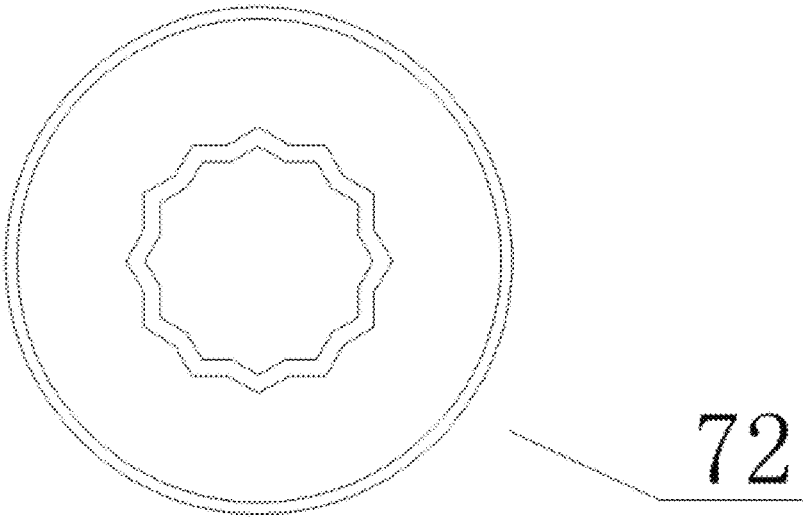
FIG. 16 is a structural diagram of an upward view of a small sleeve of the present invention.
Figure 17:
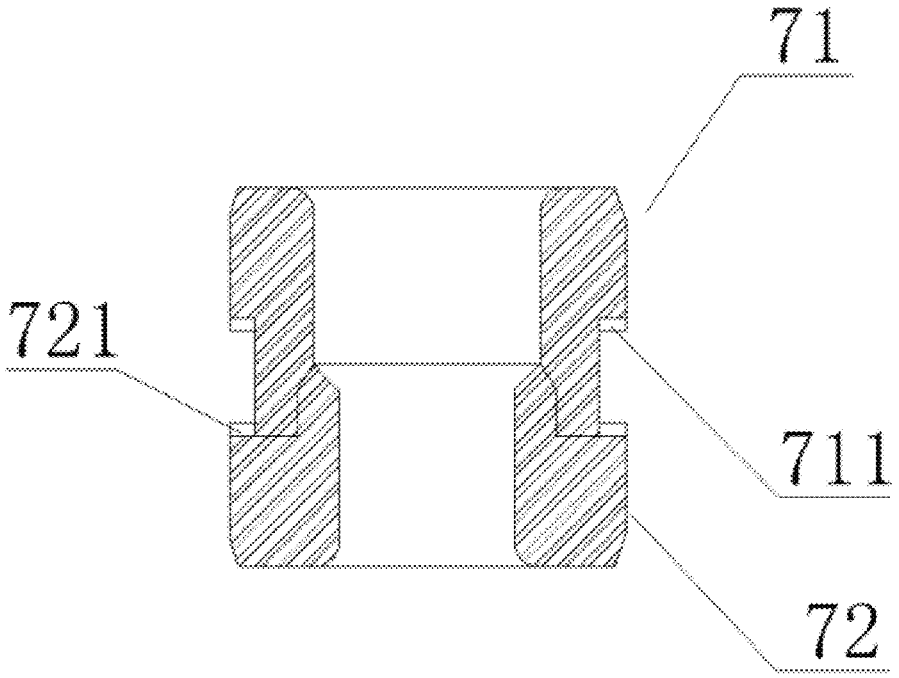
FIG. 17 is a connection structural diagram of a large sleeve and a small sleeve of the present invention.

As shown in FIGS. 1-4, the present invention relates to a damping return hammer, comprising a grip handle 1, a first elastic damping arm 2 and a second elastic damping arm 3 which are provided at the front ends of the grip handle 1, and hammer heads 4, 5 provided at the fronts of the first elastic damping arm 2 and the second elastic damping arm 3, wherein the front ends of the first elastic damping arm 2 and the second elastic damping arm 3 are upper and lower respectively, extend at a certain distance forward and are in the same longitudinal section, the two hammer heads 4, 5 are provided at the front ends of the first elastic damping arm 2 and the second elastic damping arm 3 respectively and the midperpendiculars of the hammer heads 4, 5 are coincident, a gap is provided between the two hammer heads 4, 5 and is fitted therein with a rubber energy-storage cushion block 6. The rear ends of the first elastic dampening arm 2 and the second elastic damper arm 3 are integrally connected to form a rear end integral connecting portion 8, the rear end integral connecting portion 8 is connected with the grip handle 1 via a socket wrench tooth mouth 7. the two hammer heads 4, 5 are integrally connected with the first elastic damping arm 2 and the second elastic damping arm 3, respectively and the connecting section thereof is thicker, to increase mass. the two opposite faces nearest to the two hammer heads 4, 5 are provided thereon with the groove 41, 51, the two ends of the rubber energy-storage cushion block 6 are provided with an inserting block 61 matched with the grooves 41, 51, the rubber energy-storage cushion block 6, via the inserting block 61 provided at the two ends thereof, is embedded in the grooves 41, 51 provided with the opposite faces between the two hammer heads 4, 5 to be integrally connected with the two hammer heads 4, 5.

The elasticity and hardness of the rubber energy-storage cushion block 6 are controlled to a suitable degree. The softer the rubber energy storage cushion block 6 is, the worse the synchronization of the energy released by the rubber energy storage cushion block 6 and the resulting effect of the inertia force and the impact force of the rubber energy storage cushion block 6 is, the harder the rubber energy storage cushion block 6 is, the better the synchronization of the energy released by the rubber energy storage cushion block 6 and the resulting effect of the inertia force and the impact force of the rubber energy storage cushion block 6 is. However, it must be based on this to ensure that the rubber energy-storage cushion block 6 has a suitable deformation elasticity. The harder the rubber energy-storage cushion block 6 is, the faster the reset speed after the squeezing and deformation is. The softer the rubber energy-storage cushion block 6 is, the slower the reset speed after the squeezing and deformation is. The hardness of the rubber energy-storage cushion block 6 is proportional to the mass of a hammer body, the greater the mass of the hammer body is, and the smaller the contact surface of the hammer body and the rubber energy-storage cushion block 6 is, the higher the hardness of the rubber energy-storage cushion block 6 is.

As shown in FIGS. 1-17, the socket wrench tooth mouth 7 of the present invention comprises a large sleeve 71 and a small sleeve 72, the large sleeve 71 and the small sleeve 72 are provided with a large end and a small end, respectively, the outer diameter of the small end of the small sleeve 72 is tightly matched with an inner hole of the small end of the large sleeve 71, the two outer sides of the small end of the large sleeve 71 are provided with a stop step 73, respectively, the inner sides of the steps of the large ends of the large sleeve 71 and the small sleeve 72 are provided with limit tooth mouths 711, 721, respectively; the middle sections of the first elastic dampening arm 2 and the second elastic dampening arm 3 are close to each other and the ends thereof are slightly separated, the rear end integral connecting portions 8 of the first elastic dampening arm 2 and the second elastic damper arm 3 are in a thin arm arc connection, and have the function of a spring piece when in use, the rear end integral connecting portions 8 of the first elastic dampening arm 2 and the second elastic damper arm 3 and the middle close to the middle section are hollowed out to form a forked connecting portion, the inner sides of the rear end of the forked connecting portion are provided with block slots 21, 31, respectively; the connecting end of the grip handle 1 is provided with a connecting portion 11, the two sides of the connecting portion 11 are parallel to each other, the connecting portion 11 is provided thereon with a connecting hole 12, one ring of a stop tooth mouth 13 is provided on the two sides of the connecting portion 11 and at the periphery of the connecting hole 12, the two inner sides of the connecting hole 12 are provided with a limit step 14 matched with the stop step 73 respectively provided at the two outer sides of the small end of the large sleeve 71, respectively, the rear portions of the two sides of the connecting portion 11 are provided with a convex block 15 matched with the block slots 21, 31 respectively provided at the inner side of the rear end of the forked connecting portion, respectively; when in connection, the connecting portion 11 of the connecting end of the grip handle 1 extends into a fork of the forked connecting portion of the first elastic damping arm 2 and the second elastic damping arm 3, the convex block 15 respectively provided at the rear portions of the two sides of the connecting portion 11 is embedded into the block slots 21, 31 provided at the inner side of the rear end of the forked connecting portion, under the action of external forces, the small ends of the large sleeve 71 and the small sleeve 72 are sleeved into the connecting hole 12 provided at the connecting portion 11 of the grip handle 1 from the two outer sides of the rear end of the forked connecting portion of the first elastic damping arm 2 and the second elastic damping arm 3, respectively, at this time, the stop step 73 respectively provided at the two outer sides of the small ends of the large sleeve 71 is matched with the limit step 14 respectively provided at the two inner sides of the connecting hole 12, the outer diameter of the small end of the small sleeve 72 is tightly matched with the inner hole of the small end of the large sleeve 71, the limit tooth mouths 711, 721 provided at the inner sides of the steps of the large ends of the large sleeve 71 and the small sleeve 72 are engaged with one ring of the stop tooth mouth 13 respectively provided at the periphery of the connecting hole 12 of the grip handle 1, so that the first elastic damping arm 2 and the second elastic damping arm 3 are firmly connected with the grip handle 1 together, and prevented from relative rotation when in use. The grip handle 1 comprises a metal core born 16 and a plastic handle sleeve 17 which are at the middle thereof.

Figure 18:
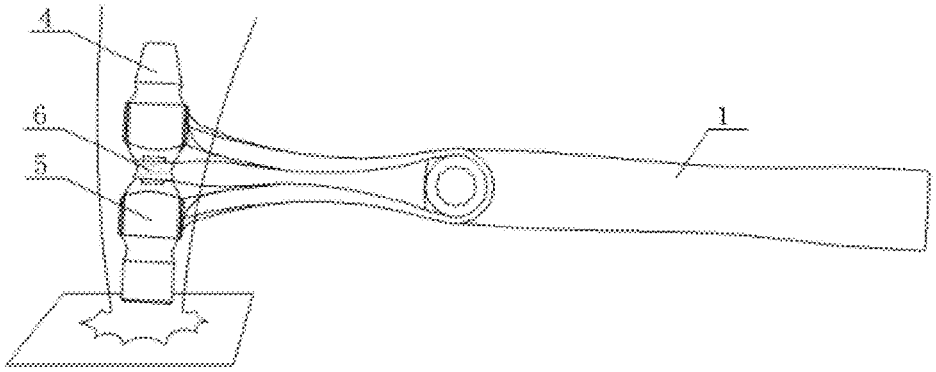
FIG. 18 is an action diagram of a hammering force when hammering begins.

FIG. 18 is an action diagram of a hammering force when hammering begins.

Figure 19:
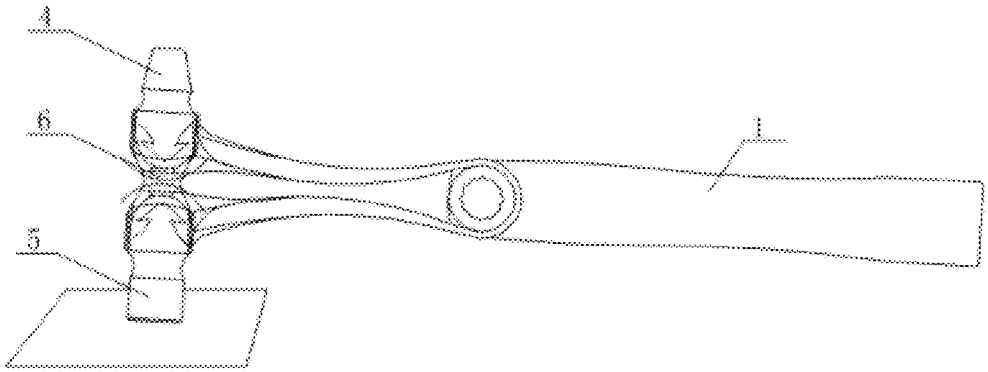
FIG. 19 is a diagram that a rubber energy-storage cushion block is squeezed to store energy when hammering is carried out.

FIG. 19 is a diagram that the rubber energy-storage cushion block is squeezed to store energy when the hammering is carried out.

Figure 20:
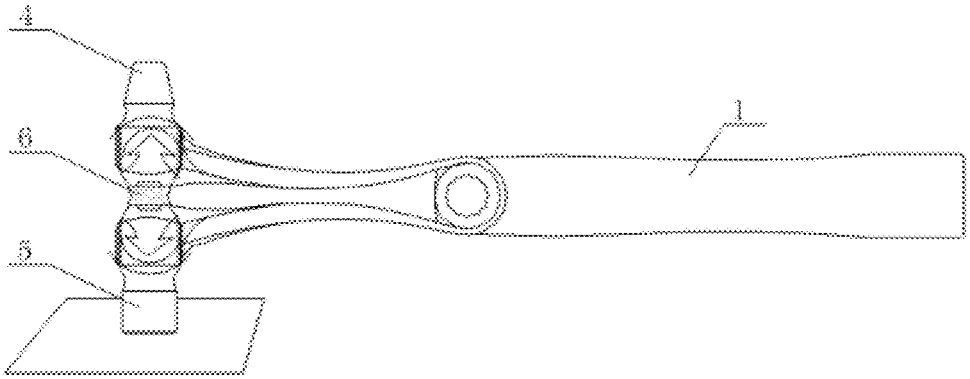
FIG. 20 is a structural diagram that a rubber energy-storage cushion block is elastically reset to release energy and that a damping arm is damped.
Figure 21:
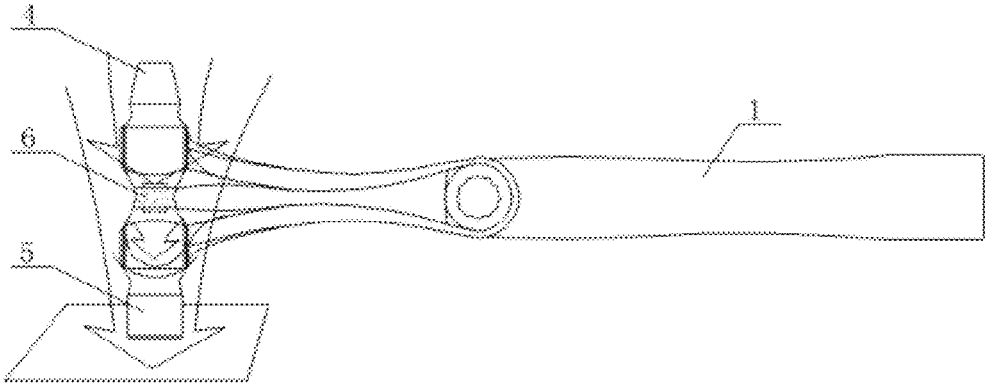
FIG. 21 is a resulting effect diagram of a hammering force, an inertia force and an elastic reset release force.

FIG. 20 is a structural diagram that the rubber energy-storage cushion block is elastically reset to release energy and that the damping arm is damped;

FIG. 21 is a resulting effect diagram of the hammering force, the inertia force and an elastic reset release force.

Another example: the first elastic damping arm 2 and the second elastic damping arm 3 are independent members and connected with the grip handle 1 via a connecting piece, respectively.

Another example: the two hammer heads 4, 5 are connected with the first elastic damping arm 2 and the second elastic damping arm 3 via the connecting piece, respectively.

The above-described examples are preferred embodiments of the present invention, however, the embodiments of the present invention are not limited by the above-described examples, any other changes, modifications, substitutions, combinations, and simplification that do not depart from the spirit and principle of the invention are all intended to be equivalent substitution manners and comprised within the protection scope of the present invention.

The invention claimed is:

1. A damping return hammer, comprising a grip handle, a first elastic damping arm and a second elastic damping arm which are provided at the front ends of the grip handle, and hammer heads provided at the fronts of the first elastic damping arm and the second elastic damping arm, wherein the front ends of the first elastic damping arm and the second elastic damping arm are upper and lower respectively, extend at a certain distance forward and are in the same longitudinal section, the two hammer heads are provided at the front ends of the first elastic damping arm and the second elastic damping arm respectively and a mid-point of each of the hammer heads is aligned with each other, a gap is provided between the two hammer heads and is fitted therein with a rubber energy-storage cushion block, wherein the rear ends of the first elastic dampening arm and the second elastic damper arm are integrally connected to form a rear end integral connecting portion, the rear end integral connecting portion is connected with the grip handle via a socket wrench tooth mouth;

wherein the socket wrench tooth mouth comprises a large sleeve and a small sleeve which are provided with a large end and a small end, respectively, the outer diameter of the small end of the small sleeve is tightly matched with an inner hole of the small end of the large sleeve, the two outer sides of the small end of the large sleeve are provided with a stop step, respectively, the inner sides of the steps of the large ends of the large sleeve and the small sleeve are provided with limit tooth mouths, respectively;

the middle sections of the first elastic dampening arm and the second elastic dampening arm are close to each other and the ends thereof are slightly separated, the rear end integral connecting portions of the first elastic dampening arm and the second elastic damper arm are in a thin arm arc connection, the rear end integral connecting portions of the first elastic dampening arm and the second elastic damper arm and the middle close to the middle section are hollowed out to form a forked connecting portion, the inner sides of the rear end of the forked connecting portion are provided with block slots, respectively;

the connecting end of the grip handle is provided with a connecting portion, the two sides of the connecting portion are parallel to each other, the connecting portion is provided thereon with a connecting hole, one ring of a stop tooth mouth is provided on the two sides of the connecting portion and at the periphery of the connecting hole, respectively, the two inner sides of the connecting hole are provided with a limit step matched with the stop step respectively provided at the two outer sides of the small end of the large sleeve, respectively, the rear portions of the two sides of the connecting portion are provided with a convex block matched with the block slots respectively provided at the inner side of the rear end of the forked connecting portion, respectively;

when in connection, the connecting portion of the connecting end of the grip handle extends into a fork of the forked connecting portion of the first elastic damping arm and the second elastic damping arm, the convex block respectively provided at the rear portions of the two sides of the connecting portion is embedded into the block slots provided at the inner side of the rear end of the forked connecting portion, under the action of external forces, the small ends of the large sleeve and the small sleeve are sleeved into the connecting hole provided at the connecting portion of the grip handle from the two outer sides of the rear end of the forked connecting portion of the first elastic damping arm and the second elastic damping arm respectively, at this time, the stop step respectively provided at the two outer sides of the small ends of the large sleeve is matched with the limit step respectively provided at the two inner sides of the connecting hole, the outer diameter of the small end of the small sleeve is tightly matched with an inner hole of the small end of the large sleeve, the limit tooth mouths provided at the inner sides of the steps of the large ends of the large sleeve and the small sleeve are engaged with one ring of the stop tooth mouth respectively provided at the periphery of the connecting hole of the grip handle, so that the first elastic damping arm and the second elastic damping arm are firmly connected with the grip handle together, and prevented from relative rotation when in use.

2. The damping return hammer according to claim 1, wherein the first elastic damping arm and the second elastic damping arm are independent members with each other and connected with the grip handle via a connecting piece, respectively.

3. The damping return hammer according to claim wherein the two hammer heads are integrally connected with the first elastic damping arm and the second elastic damping arm respectively and a connecting section thereof is thicker.

4. The damping return hammer according to claim 3, wherein two opposite faces nearest to the two hammer heads are provided thereon with groove, two ends of the rubber energy-storage cushion block are provided with an inserting block matched with the grooves, respectively, the rubber energy-storage cushion block, via the inserting block provided at the two ends thereof, is embedded in the grooves provided with the opposite faces between the two hammer heads to be integrally connected with the two hammer heads.

5. The damping return hammer according to claim wherein the two hammer heads are connected with the first elastic damping arm and the second elastic damping arm via a connecting piece, respectively.

6. The damping return hammer according to claim 5, wherein the two opposite faces nearest to the two hammer heads are provided thereon with the groove, the two ends of the rubber energy-storage cushion block are provided with the inserting block matched with the grooves, respectively, the rubber energy-storage cushion block, via the inserting block provided at the two ends thereof, is embedded in the grooves provided with the opposite faces between the two hammer heads to be integrally connected with the two hammer heads.

7. The damping return hammer according to claim 1 wherein the grip handle comprises a metal core born and a plastic handle sleeve which are at the middle thereof.

* * * * *